US006840582B2

(12) United States Patent
Burwell et al.

(10) Patent No.: US 6,840,582 B2
(45) Date of Patent: Jan. 11, 2005

(54) HEIGHT ADJUSTABLE ARM ASSEMBLY

(75) Inventors: Damon Gregory Burwell, Upper Hutt (NZ); Paul Michael Wilkinson, Wellington (NZ)

(73) Assignee: Formway Furniture Limited, Wellington (NZ)

( * ) Notice: Subject to any disclaimer, the term of this patent is extended or adjusted under 35 U.S.C. 154(b) by 0 days.

(21) Appl. No.: 10/431,692

(22) Filed: May 7, 2003

(65) Prior Publication Data

US 2003/0214171 A1 Nov. 20, 2003

(51) Int. Cl.[7] ..... A47C 7/54
(52) U.S. Cl. ..... 297/411.36
(58) Field of Search ..... 297/411.36, 353, 297/410; 403/109.2, 109.5; 248/118.3, 125.1, 125.3, 297.31, 407, 409

(56) References Cited

U.S. PATENT DOCUMENTS

| | | | |
|---|---|---|---|
| 226,082 | A | 3/1880 | Lemman |
| 272,579 | A | 2/1883 | Paulding |
| 323,060 | A | 7/1885 | Moore |
| 614,235 | A | 11/1898 | Palmer |
| 662,247 | A | 11/1900 | Vinton |
| 662,647 | A | 11/1900 | Howe |
| 1,120,686 | A | 12/1914 | Burrowes |
| 1,976,793 | A | 10/1934 | Mangold |
| 2,071,974 | A | 2/1937 | Gunlocke |
| 2,471,024 | A | 5/1949 | Cramer |
| 2,590,995 | A | 4/1952 | Merrill |
| 2,612,211 | A | 9/1952 | Gielow et al. |
| 2,796,918 | A | 6/1957 | Luckhardt |
| 2,804,129 | A | 8/1957 | Propst |
| 2,833,339 | A | 5/1958 | Liljengren |
| 2,845,997 | A | 8/1958 | Waite |
| 2,858,572 | A | 11/1958 | Burdick |
| 2,887,692 | A | 5/1959 | Gosman |
| 2,962,764 | A | 12/1960 | Trojanowski et al. |
| 3,009,578 | A | 11/1961 | Foote et al. |
| 3,015,148 | A | 1/1962 | Haddad |
| 3,030,640 | A | 4/1962 | Gosman |
| 3,041,109 | A | 6/1962 | Eames et al. |
| 3,107,991 | A | 10/1963 | Taussig |
| 3,112,987 | A | 12/1963 | Griffiths et al. |
| 3,115,678 | A | 12/1963 | Keen et al. |
| 3,124,092 | A | 3/1964 | Raynes |
| 3,165,359 | A | 1/1965 | Ashkouti |
| 3,208,085 | A | 9/1965 | Grimshaw |
| 3,214,314 | A | 10/1965 | Rowbottam |
| 3,222,698 | A | 12/1965 | Levenson |

(List continued on next page.)

FOREIGN PATENT DOCUMENTS

| | | |
|---|---|---|
| DE | 29 40 641 A1 | 4/1981 |
| DE | 30 17 163 A1 | 11/1981 |

(List continued on next page.)

*Primary Examiner*—Peter R. Brown
(74) *Attorney, Agent, or Firm*—Workman Nydegger

(57) ABSTRACT

An arm assembly includes an outer stem (52) and an inner stem (50) slidable in the outer stem and including a number of recesses (107) along its length. A biased locking device (117) engages one or more of the recesses (107) to lock the position of the inner stem (50) relative to the outer stem (52). A release member (103) operably connected to an actuator (101) has a number of recesses (110) and raised surfaces (112), the release member (103) slidable relative to the inner stem (50) between a first position in which recess(es) (110) in the release member is/are aligned with recess(es) (107) of the inner stem and the locking device (117) engages recess (es) in the stem (50) to inhibit movement thereof relative to the outer stem, and a second position in which raised surface(s) (112) of the release member align(s) with recess (es) (107) of the stem (50) to disengage the locking device from the recess(es) of the stem.

45 Claims, 9 Drawing Sheets

U.S. PATENT DOCUMENTS

| | | | |
|---|---|---|---|
| 3,273,877 | A | 9/1966 | Geller et al. |
| 3,298,743 | A | 1/1967 | Albinson et al. |
| 3,301,931 | A | 1/1967 | Morin |
| 3,314,721 | A | 4/1967 | Smith |
| 3,319,274 | A | 5/1967 | Upton |
| 3,399,883 | A | 9/1968 | McKey |
| 3,399,926 | A | 9/1968 | Hehn |
| 3,431,022 | A | 3/1969 | Poppe et al. |
| 3,434,181 | A | 3/1969 | Benzies |
| 3,534,129 | A | 10/1970 | Bartel |
| 3,546,724 | A | 12/1970 | Bastos et al. |
| 3,589,967 | A | 6/1971 | Shirakawa |
| 3,620,568 | A | 11/1971 | Morrow |
| 3,652,126 | A | 3/1972 | Folling |
| 3,712,666 | A | 1/1973 | Stoll |
| 3,740,792 | A | 6/1973 | Werner |
| 3,770,235 | A | 11/1973 | Klapproth et al. |
| 3,826,456 | A | 7/1974 | Tranter et al. |
| 3,937,518 | A | 2/1976 | Harrison |
| 3,942,835 | A | 3/1976 | Harrison |
| 3,950,026 | A | 4/1976 | Van Seenus |
| 3,974,532 | A | 8/1976 | Ecchuya |
| 4,017,118 | A | 4/1977 | Cawley |
| 4,040,661 | A | 8/1977 | Hogan et al. |
| 4,043,592 | A | 8/1977 | Fries |
| 4,054,317 | A | 10/1977 | Stumpf |
| 4,122,568 | A | 10/1978 | Bastos et al. |
| 4,123,104 | A | 10/1978 | Andres et al. |
| 4,143,910 | A | 3/1979 | Geffers et al. |
| 4,145,020 | A | 3/1979 | Webster |
| 4,154,478 | A | 5/1979 | Cohune |
| 4,158,899 | A | 6/1979 | Budimirov |
| 4,159,148 | A | 6/1979 | Schulz |
| 4,191,422 | A | 3/1980 | Inasawa et al. |
| 4,202,581 | A | 5/1980 | Fleishman |
| 4,205,878 | A | 6/1980 | Wooten |
| 4,265,482 | A | 5/1981 | Nishimura et al. |
| 4,285,545 | A | 8/1981 | Protze |
| 4,345,733 | A | 8/1982 | Ambasz et al. |
| 4,353,595 | A | 10/1982 | Kaneko et al. |
| 4,380,352 | A | 4/1983 | Diffrient |
| 4,390,204 | A | 6/1983 | Fleishman |
| 4,390,206 | A | 6/1983 | Faiks et al. |
| 4,406,496 | A | 9/1983 | Drabert et al. |
| 4,408,797 | A | 10/1983 | Franck et al. |
| 4,411,469 | A | 10/1983 | Drabert et al. |
| 4,415,203 | A | 11/1983 | Cawley |
| 4,418,958 | A | 12/1983 | Watkin |
| 4,429,917 | A | 2/1984 | Diffrient |
| 4,451,081 | A | 5/1984 | Kowalski |
| 4,456,298 | A | 6/1984 | Gottstein |
| 4,466,662 | A | 8/1984 | McDonald et al. |
| 4,479,679 | A | 10/1984 | Fries et al. |
| 4,491,364 | A | 1/1985 | Hattori et al. |
| 4,496,190 | A | 1/1985 | Barley |
| 4,498,702 | A | 2/1985 | Raftery |
| 4,502,731 | A | 3/1985 | Snider |
| 4,509,793 | A | 4/1985 | Wiesmann et al. |
| 4,515,406 | A | 5/1985 | Fujiyama et al. |
| D279,635 | S | 7/1985 | Aasen |
| 4,533,174 | A | 8/1985 | Fleishman |
| 4,534,593 | A | 8/1985 | Ojala |
| 4,540,217 | A | 9/1985 | Suzuki |
| 4,552,406 | A | 11/1985 | Ohl |
| 4,555,136 | A | 11/1985 | Dranger |
| 4,560,199 | A | 12/1985 | Sapper |
| 4,570,994 | A | 2/1986 | Lowrey |
| 4,580,837 | A | 4/1986 | Bayley |
| 4,585,272 | A | 4/1986 | Ballarini |
| 4,603,830 | A | 8/1986 | Franck |
| 4,627,602 | A | 12/1986 | Sporck |
| 4,640,548 | A | 2/1987 | Desanta |
| 4,641,885 | A | 2/1987 | Bräuning |
| 4,660,885 | A | 4/1987 | Suhr et al. |
| 4,660,887 | A | 4/1987 | Fleming et al. |
| D289,591 | S | 5/1987 | Groseth |
| 4,664,445 | A | 5/1987 | Groseth |
| 4,685,730 | A | 8/1987 | Linguanotto |
| 4,691,961 | A | 9/1987 | Rogers, Jr. et al. |
| 4,693,442 | A | 9/1987 | Sills |
| 4,693,515 | A | 9/1987 | Russo et al. |
| 4,703,974 | A | 11/1987 | Bräuning |
| 4,711,491 | A | 12/1987 | Ginat |
| 4,713,854 | A | 12/1987 | Graebe |
| 4,720,146 | A | 1/1988 | Mawbey et al. |
| 4,730,871 | A | 3/1988 | Sheldon |
| 4,733,910 | A | 3/1988 | Brennan |
| 4,752,101 | A | 6/1988 | Yurchenco et al. |
| 4,758,045 | A | 7/1988 | Edel et al. |
| D296,959 | S | 8/1988 | Gusrud |
| 4,761,033 | A | 8/1988 | Lanuzzi et al. |
| 4,765,679 | A | 8/1988 | Lanuzzi et al. |
| 4,776,633 | A | 10/1988 | Knoblock et al. |
| 4,778,218 | A | 10/1988 | Suman |
| 4,786,108 | A | 11/1988 | Dauphin |
| 4,796,952 | A | 1/1989 | Piretti |
| 4,805,928 | A | 2/1989 | Nakao et al. |
| 4,811,986 | A | 3/1989 | Hattori et al. |
| 4,823,417 | A | 4/1989 | Fukuichi |
| 4,830,430 | A | 5/1989 | Schäfer |
| 4,848,837 | A | 7/1989 | Völkle |
| 4,848,838 | A | 7/1989 | McCrackin et al. |
| 4,852,943 | A | 8/1989 | Roper |
| 4,863,218 | A | 9/1989 | McCrackin |
| 4,869,448 | A | 9/1989 | Kenyon |
| 4,869,552 | A | 9/1989 | Tolleson et al. |
| 4,871,208 | A | 10/1989 | Hodgdon |
| 4,881,777 | A | 11/1989 | Dorshimer |
| 4,889,385 | A | 12/1989 | Chadwick et al. |
| 4,909,472 | A | 3/1990 | Piretti |
| 4,914,836 | A | 4/1990 | Horovitz |
| 4,915,449 | A | 4/1990 | Piretti |
| 4,951,995 | A | 8/1990 | Teppo et al. |
| 4,962,962 | A | 10/1990 | Machate et al. |
| 4,965,899 | A | 10/1990 | Sekido et al. |
| 4,981,326 | A | 1/1991 | Heidmann |
| 4,988,145 | A | 1/1991 | Engel |
| 5,009,466 | A | 4/1991 | Perry |
| 5,009,467 | A | 4/1991 | McCoy |
| 5,013,272 | A | 5/1991 | Watkins |
| 5,015,034 | A | 5/1991 | Kindig et al. |
| 5,022,709 | A | 6/1991 | Marchino |
| 5,024,484 | A | 6/1991 | Buchacz |
| 5,026,120 | A | 6/1991 | Takeda et al. |
| 5,029,822 | A | 7/1991 | Selzer |
| 5,039,567 | A | 8/1991 | Landi et al. |
| 5,044,027 | A | 9/1991 | Moon |
| 5,044,030 | A | 9/1991 | Balaton |
| 5,046,780 | A | 9/1991 | Decker et al. |
| 5,050,931 | A | 9/1991 | Knoblock |
| 5,050,933 | A | 9/1991 | Tornero et al. |
| 5,052,068 | A | 10/1991 | Graebe |
| 5,052,753 | A | 10/1991 | Buchacz |
| 5,076,643 | A | 12/1991 | Colasanti et al. |
| 5,080,430 | A | 1/1992 | Castro |
| 5,100,201 | A | 3/1992 | Becker, III et al. |
| 5,101,811 | A | 4/1992 | Brunswick |
| 5,102,196 | A | 4/1992 | Kaneda et al. |
| 5,108,150 | A | 4/1992 | Stas et al. |
| 5,113,540 | A | 5/1992 | Sereboff |
| 5,121,934 | A | 6/1992 | Decker et al. |

5,137,329 A 8/1992 Neale
5,144,708 A 9/1992 Pekar
5,171,209 A 12/1992 Gamba
5,172,436 A 12/1992 Masuda
5,190,348 A 3/1993 Colasanti
5,195,199 A 3/1993 Sereboff
5,251,958 A 10/1993 Roericht et al.
5,265,938 A 11/1993 Melhuish et al.
5,288,134 A 2/1994 Hewko et al.
D345,060 S 3/1994 Duncan
5,292,097 A 3/1994 Russell
5,304,271 A 4/1994 Gusakov
5,308,028 A 5/1994 Kornberg
5,308,142 A 5/1994 Forslund, III et al.
5,308,145 A 5/1994 Koepke et al.
5,314,235 A 5/1994 Johnson
5,314,237 A 5/1994 Koepke et al.
5,314,240 A 5/1994 Ishi et al.
5,318,347 A 6/1994 Tseng
5,320,409 A 6/1994 Katoh et al.
5,324,096 A 6/1994 Schultz
5,330,255 A 7/1994 Stawicki
5,340,191 A 8/1994 May
5,346,283 A 9/1994 Steininger et al.
5,346,284 A 9/1994 Dauphin
5,348,372 A 9/1994 Takamatsu et al.
5,348,415 A 9/1994 Carlsson
5,354,120 A 10/1994 Völkle
5,368,364 A 11/1994 Kanai
5,368,365 A 11/1994 Feldberg
5,372,487 A 12/1994 Pekar
5,380,065 A 1/1995 Rohrer
5,382,079 A 1/1995 Wilson et al.
5,388,892 A 2/1995 Tornero
5,393,124 A 2/1995 Neil
5,393,125 A 2/1995 Watson et al.
5,401,077 A 3/1995 Hosoe
5,415,459 A 5/1995 Schultz
5,417,473 A 5/1995 Braüning
5,419,617 A 5/1995 Schultz
5,435,626 A 7/1995 Lai
5,439,267 A 8/1995 Peterson et al.
5,444,881 A 8/1995 Landi et al.
5,452,937 A 9/1995 Piretti
5,484,187 A 1/1996 Doerner et al.
5,486,035 A 1/1996 Koepke et al.
5,505,521 A 4/1996 Meiller et al.
5,513,898 A 5/1996 Kanai et al.
5,524,966 A 6/1996 Piretti
5,542,743 A 8/1996 Olson et al.
5,547,252 A 8/1996 Pfenniger
5,558,399 A 9/1996 Serber
5,562,324 A 10/1996 Massara et al.
5,567,010 A 10/1996 Sparks
5,567,011 A 10/1996 Sessini
5,575,534 A 11/1996 Yu
5,577,807 A 11/1996 Hodge et al.
5,580,127 A 12/1996 Piretti
5,584,533 A 12/1996 Schrewe
5,586,810 A 12/1996 Liu
5,590,934 A 1/1997 Gibbs
5,595,806 A 1/1997 Korfmacher
5,597,208 A 1/1997 Bonutti
5,599,067 A 2/1997 Schuelke et al.
5,613,736 A 3/1997 Schaked et al.
5,617,595 A 4/1997 Landi et al.
5,620,233 A 4/1997 Corwin
5,630,647 A 5/1997 Heidmann et al.
5,637,076 A 6/1997 Hazard et al.
5,641,203 A 6/1997 Van De Riet et al.
5,645,317 A 7/1997 Onishi et al.
5,647,638 A 7/1997 Ritt et al.
5,649,740 A 7/1997 Hodgdon
5,649,741 A 7/1997 Beggs
5,655,814 A 8/1997 Gibbs
5,660,438 A 8/1997 Tedesco
5,660,439 A 8/1997 Unwalla
5,664,842 A 9/1997 Tseng
5,666,861 A 9/1997 Fee et al.
5,667,277 A 9/1997 Van De Riet
5,669,665 A 9/1997 Nowak
5,676,483 A 10/1997 Koubek
5,678,891 A 10/1997 O'Neill et al.
5,704,688 A 1/1998 Schrewe et al.
5,711,575 A 1/1998 Hand et al.
5,713,631 A 2/1998 O'Neill et al.
5,725,277 A 3/1998 Knoblock
5,749,628 A 5/1998 Synder et al.
5,765,804 A 6/1998 Stumpf et al.
5,765,914 A 6/1998 Britain et al.
5,765,919 A 6/1998 Karlsson et al.
5,769,497 A 6/1998 Tsai
5,772,282 A 6/1998 Stumpf et al.
5,775,774 A 7/1998 Okano
5,791,733 A 8/1998 van Hekken et al.
5,791,735 A 8/1998 Helman
5,791,736 A 8/1998 Herbert
5,795,026 A 8/1998 Dral et al.
5,797,652 A 8/1998 Darbyshire
5,806,927 A 9/1998 Schneider
5,810,439 A 9/1998 Roslund, Jr.
5,823,619 A 10/1998 Heilig et al.
5,826,940 A 10/1998 Hodgdon
5,829,721 A 11/1998 Jurik et al.
5,829,839 A 11/1998 Wilkerson et al.
5,839,786 A 11/1998 Cvek
5,845,964 A 12/1998 Phoon
5,848,823 A 12/1998 Su
5,853,223 A 12/1998 Ritt et al.
5,860,699 A 1/1999 Weeks
5,860,701 A 1/1999 Jungjohann et al.
5,868,466 A 2/1999 Massara et al.
5,868,467 A 2/1999 Moll
5,871,258 A 2/1999 Battey et al.
5,876,097 A 3/1999 Cao
5,884,975 A 3/1999 Su
5,890,245 A 4/1999 Klearman et al.
5,895,095 A 4/1999 Chen
5,902,011 A 5/1999 Hand et al.
5,904,397 A 5/1999 Fismen
5,909,923 A 6/1999 DeKraker
5,909,924 A 6/1999 Roslund, Jr.
5,918,940 A 7/1999 Wakamatsu et al.
5,927,804 A 7/1999 Cuevas
5,927,811 A 7/1999 Tseng
5,931,531 A 8/1999 Assmann
5,931,536 A 8/1999 Wu
5,931,537 A 8/1999 Gollin et al.
5,934,749 A 8/1999 Pond et al.
5,934,758 A 8/1999 Ritch et al.
D413,875 S 9/1999 Lawrence
5,951,109 A 9/1999 Roslund, Jr. et al.
5,954,393 A 9/1999 Perrin
5,957,534 A 9/1999 Wilkerson et al.
5,964,503 A 10/1999 Inoue
5,967,608 A 10/1999 Van Sickle
5,967,613 A 10/1999 McKeever
5,971,481 A 10/1999 Emmenegger et al.
5,971,484 A 10/1999 Lamart et al.
5,975,632 A 11/1999 Ginat
5,975,634 A 11/1999 Knoblock et al.
5,975,636 A 11/1999 Koch et al.

5,975,637 A 11/1999 Geuss et al.
5,975,639 A 11/1999 Wilson et al.
5,979,984 A 11/1999 DeKraker et al.
D417,793 S 12/1999 Ritch et al.
5,997,093 A 12/1999 Gollin et al.
5,997,094 A 12/1999 Cvek
6,010,189 A 1/2000 Hybarger et al.
6,015,187 A 1/2000 Roslund, Jr. et al.
6,017,091 A 1/2000 Cao
6,022,078 A 2/2000 Chang
6,027,169 A 2/2000 Roslund, Jr.
6,030,041 A 2/2000 Hsiao
6,035,901 A 3/2000 Stumpf et al.
6,039,397 A 3/2000 Ginat
D423,261 S 4/2000 Ritch et al.
6,045,183 A 4/2000 Weber
6,045,191 A 4/2000 Piretti
6,050,634 A 4/2000 Yamagishi et al.
6,053,574 A 4/2000 Opsvik
6,053,577 A 4/2000 Arko et al.
6,053,578 A 4/2000 van Hekken et al.
6,053,579 A 4/2000 Nelson et al.
6,056,360 A 5/2000 Schneider
6,059,363 A 5/2000 Roslund, Jr. et al.
6,059,368 A 5/2000 Stumpf et al.
6,059,370 A 5/2000 Kanyer et al.
6,062,646 A 5/2000 Bock
6,062,647 A 5/2000 Mei
6,074,012 A 6/2000 Wu
6,076,892 A 6/2000 van Hekken et al.
6,079,785 A 6/2000 Peterson et al.
6,086,153 A 7/2000 Heidmann et al.
6,098,000 A 8/2000 Long et al.
6,106,069 A 8/2000 Bock
6,106,070 A 8/2000 Ritt et al.
6,116,688 A 9/2000 Wilkerson et al.
6,120,096 A 9/2000 Miotto
6,120,099 A 9/2000 Reikerås et al.
6,129,419 A 10/2000 Neale
6,132,001 A 10/2000 Su
6,139,106 A 10/2000 Aldridge
6,139,107 A 10/2000 Lee
D433,854 S 11/2000 Diffrient
6,149,231 A 11/2000 Wüstholz
6,149,236 A 11/2000 Bräuning
D435,746 S 1/2001 Diffrient
D436,457 S 1/2001 Ambasz
D436,749 S 1/2001 Arad
6,168,236 B1 1/2001 Chen
6,168,237 B1 1/2001 Lamart et al.
6,168,239 B1 1/2001 Conner et al.
6,174,031 B1 1/2001 Lindgren et al.
6,176,548 B1 1/2001 Thole et al.
6,176,550 B1 1/2001 Lamart et al.
D437,497 S 2/2001 Bräuning
D437,701 S 2/2001 Bellini et al.
6,182,315 B1 2/2001 Lee
6,186,594 B1 2/2001 Valiquette et al.
6,192,565 B1 2/2001 Tame
D439,450 S 3/2001 Perl
D440,068 S 4/2001 Bräuning
6,209,840 B1 4/2001 Chen
6,209,958 B1 4/2001 Thole
6,209,961 B1 4/2001 Chen
6,213,556 B1 4/2001 Chen
6,227,511 B1 5/2001 DeCosta
6,279,184 B1 8/2001 George, II
6,286,900 B1 9/2001 Roark
6,290,295 B1 9/2001 Benden et al.
6,295,674 B1 10/2001 Smith-McKelvey et al.
6,296,308 B1 10/2001 Cosentino et al.
6,296,312 B1 10/2001 Congleton et al.
6,296,313 B1 10/2001 Wu
6,302,486 B1 10/2001 Lamart et al.
6,315,362 B1 11/2001 Chuang
6,318,800 B1 11/2001 DeKraker
6,336,680 B1 1/2002 Lee
6,343,839 B1 2/2002 Simons, Jr. et al.
6,349,992 B1 2/2002 Knoblock et al.
6,386,634 B1 5/2002 Stumpf et al.
6,394,545 B2 5/2002 Knoblock et al.
6,394,553 B1 * 5/2002 McAllister et al. .... 297/411.36
6,398,309 B1 * 6/2002 Chen ..... 297/411.36
6,419,323 B1 * 7/2002 Chu et al. ..... 297/411.36
6,422,652 B1 7/2002 Roslund, Jr. et al.
6,460,932 B1 10/2002 Kopish et al.
6,497,392 B1 12/2002 Perkins
6,585,322 B1 * 7/2003 Lai ..... 297/411.36
2001/0000939 A1 5/2001 Roslund, Jr. et al.
2002/0096920 A1 7/2002 Watson et al.
2002/0149247 A1 10/2002 Diffrient

FOREIGN PATENT DOCUMENTS

DE 42 16 358 A1 11/1992
DE 43 17 610 A1 12/1994
DE 94 14 023.5 2/1995
DE 295 02 429 U1 12/1995
DE 295 19 794 U1 5/1997
DE 297 06 901 U1 5/1997
DE 196 03 789 A1 8/1997
DE 197 16 347 A1 10/1998
DE 299 01 666 U1 4/2000
DE 198 48 400 A1 5/2000
EP 0 032 839 A2 7/1981
EP 0 154 582 A2 9/1985
EP 0 164 266 A2 11/1985
EP 0 164 267 A2 12/1985
EP 0 166 870 A1 1/1986
EP 0 216 578 A2 4/1987
EP 0 249 584 A2 12/1987
EP 0 277 912 A1 8/1988
EP 0 338 050 B1 10/1989
EP 0 499 594 A1 8/1992
EP 0 383 890 B1 1/1993
EP 0 560 736 A1 9/1993
EP 0 561 518 A1 9/1993
EP 0 0 587 537 A1 3/1994
EP 0 589 190 A1 3/1994
EP 0 589 834 A1 3/1994
EP 0 591 932 A1 4/1994
EP 0 591 933 A1 4/1994
EP 0 741 985 A1 11/1996
EP 0 801 913 A1 10/1997
EP 0 809 957 A2 12/1997
EP 0 836 819 A2 4/1998
EP 0 857 443 A2 8/1998
EP 0 880 921 A2 12/1998
EP 0 885 575 A2 12/1998
EP 0 937 426 A2 8/1999
EP 0 958 765 A2 11/1999
EP 0 960 586 A2 12/1999
EP 0 963 721 A1 12/1999
EP 1 013 198 A2 6/2000
EP 1 033 098 A1 9/2000
EP 1 044 634 A1 10/2000
EP 1 057 428 A1 12/2000
EP 1 059 051 A1 12/2000
EP 1 106 110 A1 6/2001
EP 1 161 903 A2 12/2001
EP 1 192 875 A2 4/2002
EP 1 226 773 A1 7/2002
FR 2 558 360 7/1985

| | | | |
|---|---|---|---|
| FR | 2 586 180 | | 2/1987 |
| FR | 2 586 541 | | 3/1987 |
| FR | 2 641 453 | | 7/1990 |
| GB | 1 222 908 | | 2/1971 |
| GB | 2 057 257 | A | 4/1981 |
| GB | 2 068 717 | A | 8/1981 |
| GB | 1 603 355 | | 11/1981 |
| GB | 1 603 356 | | 11/1981 |
| GB | 2 107 576 | A | 5/1983 |
| GB | 2 165 445 | A | 4/1986 |
| GB | 2 189 990 | A | 11/1987 |
| GB | 2 232 884 | A | 1/1991 |
| GB | 2 255 008 | A | 10/1992 |
| GB | 2 255 277 | A | 11/1992 |
| NZ | 184194 | | 2/1981 |
| WO | WO 80/02791 | | 12/1980 |
| WO | WO 87/04909 | | 8/1987 |
| WO | WO 89/03648 | | 5/1989 |
| WO | WO 90/00871 | | 2/1990 |
| WO | WO 90/02504 | | 3/1990 |
| WO | WO 91/03969 | | 4/1991 |
| WO | WO 92/03073 | | 3/1992 |
| WO | WO 92/06622 | | 4/1992 |
| WO | WO 93/03653 | | 3/1993 |
| WO | WO 93/25121 | | 12/1993 |
| WO | WO 94/08491 | | 4/1994 |
| WO | WO 94/24904 | | 11/1994 |
| WO | WO 95/00052 | | 1/1995 |
| WO | WO 95/28866 | | 11/1995 |
| WO | WO 96/02166 | | 2/1996 |
| WO | WO 96/07344 | | 3/1996 |
| WO | WO 96/39900 | | 12/1996 |
| WO | WO 96/39901 | | 12/1996 |
| WO | WO 96/39902 | | 12/1996 |
| WO | WO 96/39903 | | 12/1996 |
| WO | WO 97/23152 | | 7/1997 |
| WO | WO 98/02067 | | 1/1998 |
| WO | WO 98/08424 | | 3/1998 |
| WO | WO 98/32353 | | 7/1998 |
| WO | WO 98/47413 | | 10/1998 |
| WO | WO 98/48668 | | 11/1998 |
| WO | WO 98/48670 | | 11/1998 |
| WO | WO 99/21456 | | 5/1999 |
| WO | WO 99/27820 | | 6/1999 |
| WO | WO 00/22959 | | 4/2000 |
| WO | WO 00/22960 | | 4/2000 |
| WO | WO 00/23027 | | 4/2000 |
| WO | WO 00/24295 | | 5/2000 |
| WO | WO 00/24296 | | 5/2000 |
| WO | WO 00/53058 | | 9/2000 |
| WO | WO 00/64311 | | 11/2000 |
| WO | WO 00/72730 | A1 | 12/2000 |
| WO | WO 00/74531 | A2 | 12/2000 |
| WO | WO 01/03548 | A1 | 1/2001 |
| WO | WO 01/39633 | A1 | 6/2001 |
| WO | WO 01/70072 | A1 | 9/2001 |

* cited by examiner

HEIGHT ADJUSTABLE ARM ASSEMBLY

FIELD OF THE INVENTION

The present relation relates to an arm assembly. In particular, although not exclusively, the invention relates to an arm assembly for supporting an armrest from an office chair where the height of the armrest is adjustable for the comfort of the occupant. While the invention is described herein in terms of an office chair, it will be understood that the invention can be implemented in any type of chair including a wheelchair. Moreover, the invention might also have application beyond chairs. Arm assemblies of the invention may be attachable to a table or workstation, for example to be used as typists' aids.

BACKGROUND TO THE INVENTION

Human beings come in all different shapes and sizes. For this reason, office chairs generally allow for adjustment eg seat height, seat depth. It is also known to provide for adjustment of armrests. A known adjustment includes a twisting action about a vertical axis. Another known type permits a twisting action as well as sideways movement. Another known type permits motion of the armrest in a predetermined oval path within a horizontal plane. Seat depth adjustment is one of the major adjustments required by an occupant of a chair and is to be commonly found on commercial office chairs. As the occupant adjusts their seat depth, the positioning of the armrests relative to the seat will vary even to the extent that the positioning of the armrests may be totally inappropriate for the occupant. Known office chairs do not satisfactorily meet the requirement of being easily adjustable to accommodate the seat depth position.

Another shortcoming of known armrest adjustment mechanisms is that they are not easy to adjust. Further, many of them have a large number of moving parts, meaning they can be expensive to manufacture and difficult to repair.

Yet another shortcoming of some of the known adjustable armrests is that they rely on force for adjustment. Therefore, while the occupant is using the chair in the normal fashion, the armrest will function as intended in the position selected by the user. However, if the user unintentionally bears considerable force against the armrests they can move. This can occur when the occupant uses the armrests to lift himself out of the chair. This can be destabilising to the occupant and moreover, requires the occupant to re-adjust the armrests when he resumes occupancy of the chair.

It is therefore an object of the present invention to provide an armrest assembly which overcomes or at least addresses some of the foregoing disadvantages, and/or at least provides the public with a useful choice.

SUMMARY OF THE INVENTION

In accordance with an aspect of the present invention, there is provided a height adjustable arm assembly for a chair including: an outer stem attachable to a first chair component; an inner stem attachable to a second chair component and slidably received in the outer stem and including a plurality of recesses spaced along a length thereof; a locking device biased to engage one or more of the plurality of recesses to lock the position of the inner stem relative to the outer stem; and a release member in operable connection with an actuator and having a plurality of recesses with raised surfaces therebetween, the release member being slidably moveable relative to the inner stem between a first position in which at least one of the recesses in the release member is aligned with at least one of the recesses of the inner stem and the locking device engages at least one of the recesses in the inner stem to inhibit movement of the inner stem relative to the outer stem, and a second position in which one or more of the raised surfaces of the release member aligns with the one or more recesses of the inner stem to remove the locking device from engagement with the recess or recesses and to provide a surface over which the locking device can slide to enable relative movement between the inner stem and the outer stem.

The release member preferably includes camming surfaces adjacent the recesses, the camming surfaces configured so that when one of the camming surfaces is moved into alignment with the recess or recesses of the inner stem with which the locking device is engaged, the locking device is progressively forced from engagement with said recess or recesses of the inner stem. Preferably, the raised surfaces of the release member are provided between respective camming surfaces and respective following recesses, such that initial movement of the release member progressively forces the locking device from the recess or recesses of the inner stem, and further movement brings one of the raised surfaces into alignment with the recess or recesses of the inner stem.

The inner stem preferably includes a longitudinal channel adjacent the plurality of recesses, and the release member is slidably mounted in the longitudinal channel.

The inner stem preferably includes two rows of recesses with the channel being defined between the rows of recesses, and the release member is slidably mounted in the longitudinal channel between the two rows of recesses.

In a preferred embodiment, a liner is mounted in the outer stem, with the moving inner stem telescopically received in the liner. The liner may be a two-piece liner. Preferably, the liner is made of a plastics material.

The liner may include an aperture for receipt of the locking device, with the locking device extending inwardly through the aperture. The liner suitably includes a strengthened region adjacent the aperture for receipt of the locking device, to enhance the rigidity of the locking device.

The liner may include an outwardly-extending leaf spring to reduce slack between the liner and the outer stem. Additionally or alternatively, the liner may include an inwardly-extending leaf spring to reduce slack between the liner and in the inner stem.

The locking device preferably comprises a locking pin which is biased towards the recesses of the inner stem. A coil spring may extend between a surface of the outer stem and the locking pin, to bias the locking pin towards the recesses. Alternatively, a leaf spring or spring wire may bias the locking pin towards the recesses of the inner stem. The liner preferably includes a groove for receipt of the leaf spring or spring wire which extends behind the locking pin to bias the locking pin towards the recesses of the inner stem. The liner may include strengthening ribs, and the groove may be defined by an undercut in one or more of the strengthening ribs.

The locking device preferably comprises a locking pin which is biased towards the recesses of the inner stem. A coil spring may extend between a surface of the outer stem and the locking pin, to bias the locking pin towards the recesses. Alternatively, a leaf spring or spring wire may bias the locking pin towards the recesses of the inner stem.

The outer stem preferably includes a stem cap to close off the end of the outer stem opposite to the end through which the inner stem extends. In the embodiment having a liner, the stem cap may be removable to enable the sleeve to be removed from the outer stem.

The release member preferably comprises an elongate member, and more preferably comprises a rod.

The recesses in the inner stem and in the release member are preferably in the form of notches.

In a preferred embodiment, the inner stem is an upper stem configured for attachment to an armrest, and the outer stem is a lower stem configured for attachment to a chair.

A camming surface may define an edge of each recess of the release member towards the outer stem, such that movement of the release member away from the outer stem forces the locking device from the recess or recesses of the inner stem. Preferably, the release member is biased in a direction toward the outer stem. The actuator preferably includes a height adjustment lever extending through the inner stem at or adjacent an end thereof distal from the outer stem, which lever is in operable engagement with the release member. Preferably, the lever is slidably mounted in the inner stem such that moving the lever in a direction away from the outer stem moves the release member in a direction away from the outer stem and thereby forces the locking device from the recess or recesses of the inner stem, enabling the relative positions of the inner and outer stems to be adjusted.

Alternatively, a camming surface may define an edge of each recess of the release member away from the outer stem, such that movement of the release member towards the outer stem forces the locking device from the recess or recesses of the inner stem. Preferably, the release member is biased in a direction away from the inner stem. The actuator preferably includes a height adjustment lever extending through the inner stem at or adjacent an end thereof distal from the outer stem, which lever is in operable engagement with the release member. Preferably, the lever is pivotally mounted to the inner stem such that moving an outer part of the lever in a direction away from the outer stem moves the release member toward the outer stem and thereby forces the locking device from the recess or recesses of the inner stem, enabling the relative positions of the inner and outer stems to be adjusted.

In an alternative embodiment, the inner stem is a lower stem configured for attachment to a chair, and the outer stem is an upper stem configured for attachment to an armrest.

A camming surface may define an edge of each recess of the release member towards the outer stem, such that movement of the release member away from the outer stem forces the locking device from the recess or recesses of the inner stem. Preferably, the release member is biased in a direction toward the outer stem. The actuator preferably includes a height adjustment lever extending through the outer stem at or adjacent an end thereof distal from the inner stem, which lever is in operable engagement with the release member. Preferably, the lever is pivotally mounted to the outer stem such that moving an outer part of the lever away from the inner stem moves the release member away from the outer stem and thereby forces the locking device from the recess or recesses of the inner stem, enabling the relative positions of the inner and outer stems to be adjusted Alternatively, a camming surface may define an edge of each recess of the release member away from the outer stem, such that movement of the release member towards the outer stem forces the locking device from the recess or recesses of the inner stem. Preferably, the release member is biased in a direction away from the inner stem. The actuator preferably includes a height adjustment lever extending through the inner stem at or adjacent an end thereof distal from the inner stem, which lever is in operable engagement with the release member. Preferably, the lever is slidably mounted to the outer stem such that moving the lever in a direction away from the inner stem moves the release member toward the outer stem and thereby forces the locking device from the recess or recesses of the inner stem, enabling the relative positions of the inner and outer stems to be adjusted.

The arm assembly preferably includes a cover which covers the notches of the inner stem and the release member. In the embodiment including a liner in the outer stem, the cover preferably comprises a tongue extending from the liner.

In accordance with a further aspect of the present invention, there is provided an office chair including a pair of height adjustable arm assemblies as outlined above attached thereto, the arm assemblies supporting armrests from the chair.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

Preferred embodiments of the present invention will now be described by way of example only and with reference to the accompanying drawings in which.

DETAILED DESCRIPTION OF PREFERRED EMBODIMENT

Figure 1:
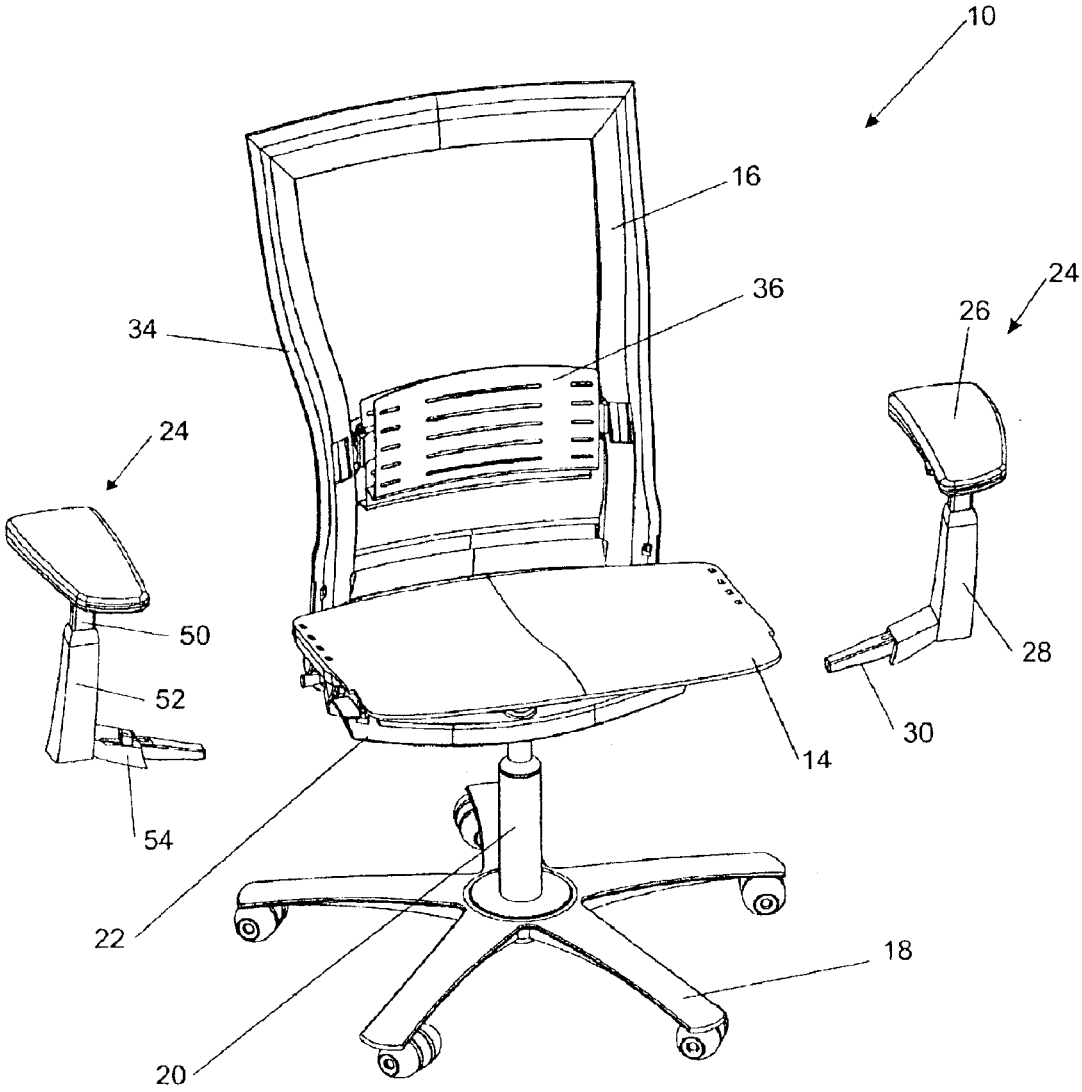
FIG. 1 is an exploded perspective view illustrating a chair with two detachable arm assemblies.

FIG. 1 illustrates an office chair including a main assembly 10 having a seat portion 14 and a back portion 16. The seat portion 14 and the back portion 16 are supported above the ground by a support frame including a wheeled base 18 and a central support column 20. The support frame may also optionally include a mechanism enabling the back portion 16 to recline with a synchronous tilting action of the seat portion 14 as the back portion 16 reclines. The details of the mechanism are not important to the present invention and the reader may refer to our co-pending patent application U.S. Ser. No. 09/953,816, the details of which are incorporated by reference herein. The central support column 20 may house a pneumatic spring (not shown) for height adjustment of the seat portion 14 in conventional fashion. The pneumatic spring is connected to the main transom 22 of the chair, which extends transversely across the chair and is connected to the pneumatic spring by way of central spring connection ring.

FIG. 1 also illustrates two detachable arm assemblies 24, which may be the arm assemblies according to the preferred embodiment shown in FIGS. 2 to 6. The arm assemblies 24 shown in FIG. 1 include an upper armrest 26 which is preferably padded for user comfort. Each arm assembly also includes an upright support structure 28. The armrest 26 is mounted to the upper end of the upright support structure 28. The lower end of the upright support structure has an elongate attachment portion 30 extending inwardly therefrom in a downwardly inclined angle. The elongate attachment portion 30 engages within one end of the main transom.

The support structure 28 of the arm assembly includes an upper stem telescopically received in a hollow lower stem 52. The upper stem 50 and the lower stem 52 are adjustable relative to one another to effect height adjustment. Extending at a downwardly inclined angle from a lower part of the lower stem 52 is leg portion 54. The elongate attachment portion 30 may be connected to the lower end of the leg portion 54.

The upper stem 50 supports a fixed portion (not shown in FIG. 1) in normally fixed disposition thereto (given that the fixed portion is height adjustable as will subsequently be explained). An armrest may be movably attached to the fixed portion. The details of this attachment are not important to the present invention and the reader may refer to our co-pending patent application U.S. Ser. No. 09/953,850, the details of which are incorporated by reference herein.

The height adjustable arm assembly shown in FIGS. 2 to 6 may be used with the chair of FIG. 1, and may be removably attached to the chair or may be permanently affixed to the chair. The details of the attachment are not important to the present invention and the reader may refer to our co-pending patent application U.S. Ser. No. 09/953,850, the details of which are incorporated by reference herein.

Figure 2:
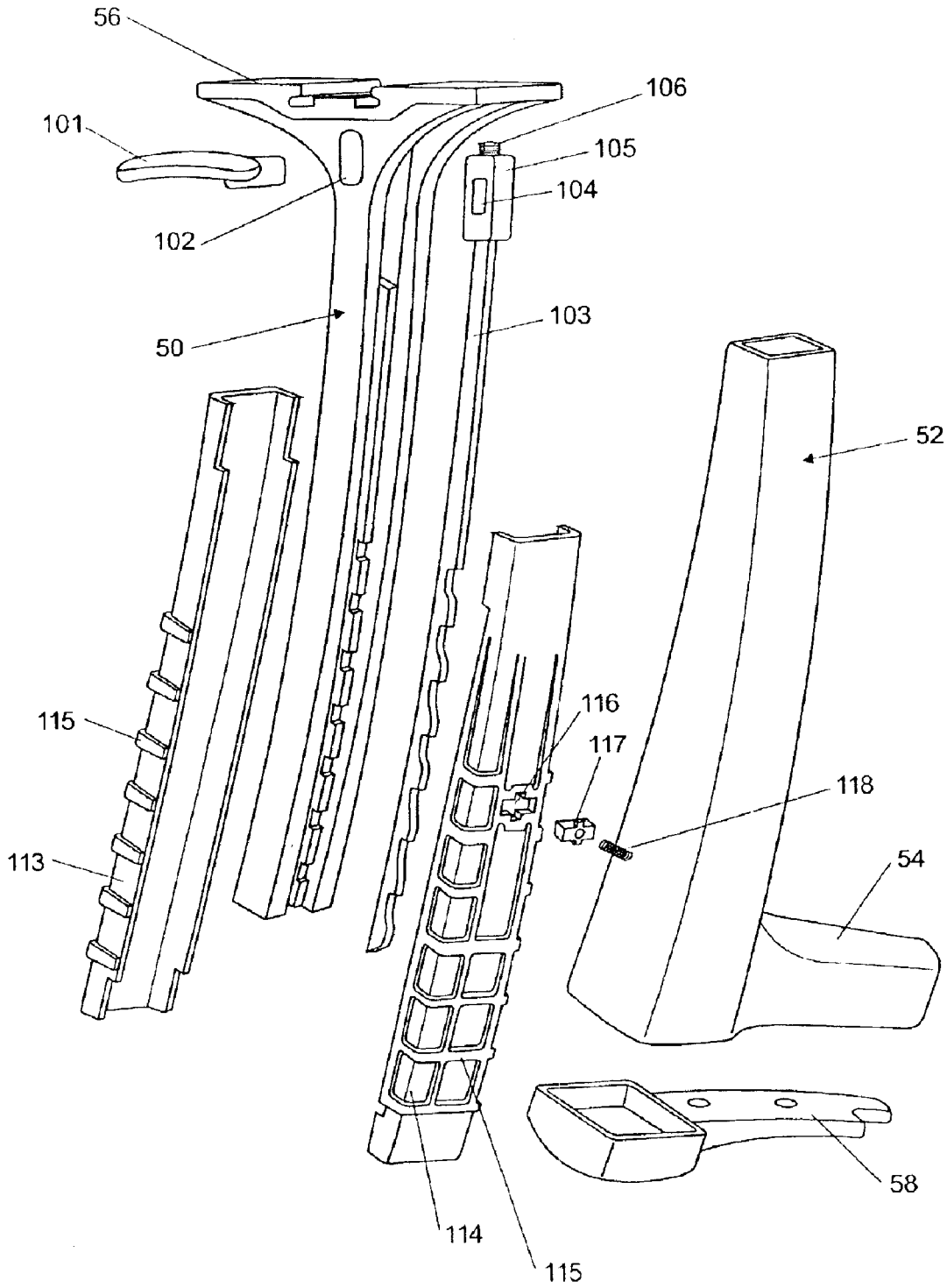
FIG. 2 is an exploded perspective view of the components of an arm assembly in accordance with a preferred embodiment of the present invention, which may be used with the chair of FIG. 1.

FIG. 2 illustrates an exploded view of the arm assembly 24 with the upper inner stem 50 removed from the lower outer stem 52 within which it is normally telescopically received. The upper end of the upper stem has a fixed portion 56 to which an armrest may be movably or fixedly attached. The upper stem 50 includes a height adjustment actuator in the form of a height adjustment lever 101, and a release member in the form of a rod 103 which is slidably received in a channel of the upper stem 50. The lever 101 extends through an aperture 102 adjacent the upper end of the stem 50 and into a recess 104 in an enlarged head 105 of the rod 103. A compression spring 106 downwardly biases the rod 103 away from the fixed portion 56 of the upper stem.

Figure 4:
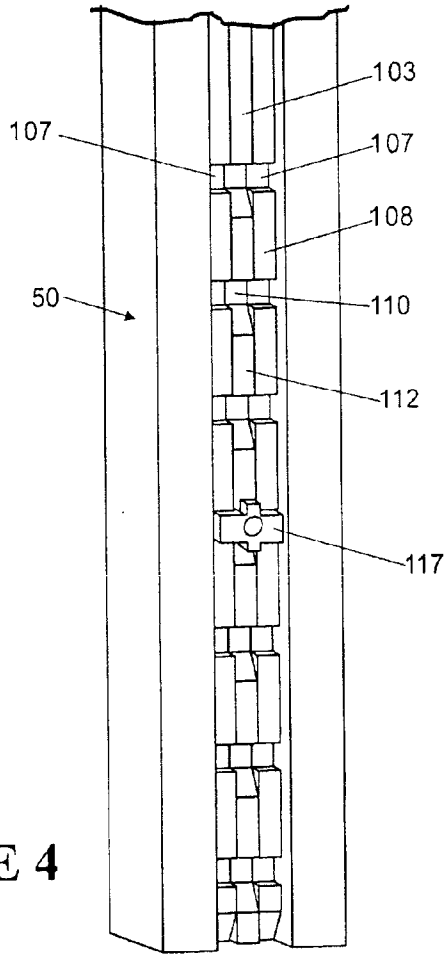
FIG. 4 is a partial assembled perspective view of the upper inner stem of FIG. 2.
Figure 3:
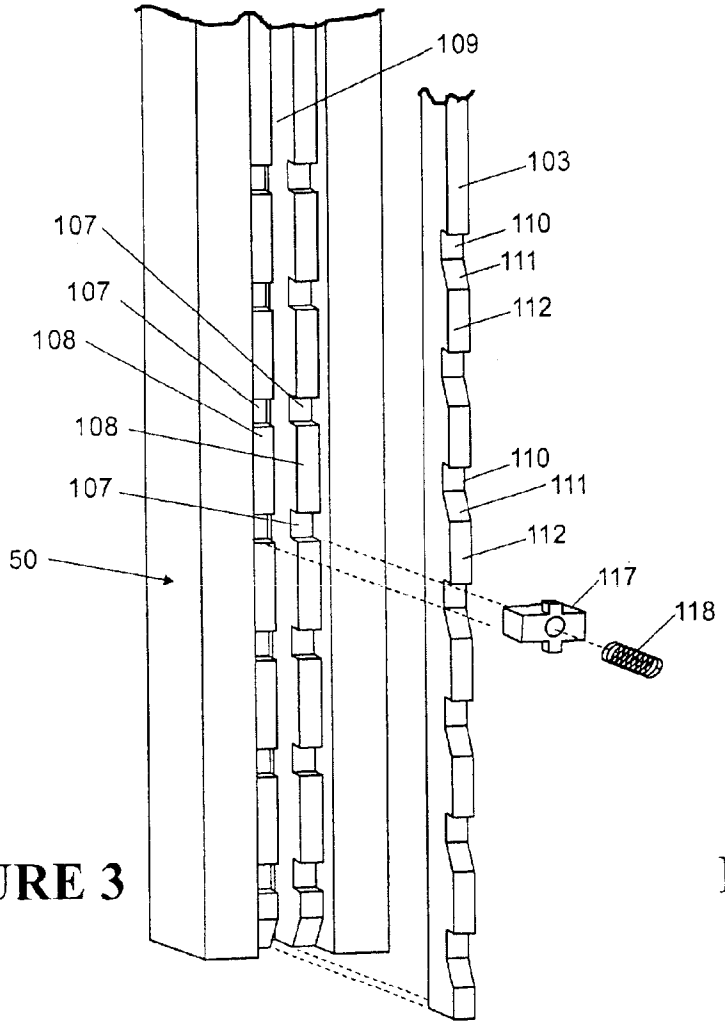
FIG. 3 is an exploded perspective view of the upper inner stem of the arm assembly of FIG. 2.

As can be seen from FIGS. 3 and 4, the upper stem 50 includes two vertical rows of recesses which are preferably in the form of notches 107 which notches in each row are spaced by substantially flat raised surfaces 108. The two rows of notches define the channel 109 within which the rod 103 is slidably received. It will be appreciated by a person skilled in the art that while two rows of notches 107 are present in the preferred embodiment of the present invention, the invention may function satisfactorily with one or more rows of notches or recesses in the upper stem 50. Further, the rod 103 need not be located between the rows of notches, and need only be located adjacent one of the rows.

The rod 103 includes a plurality of recesses which are preferably in the form of notches 110 corresponding to the notches of the upper stem 50. Defining one edge of each notch 110 is an angled camming surface 111. While each camming surface 111 is shown as being linear, curved concave or convex surfaces could be provided to provide a smooth release action. Between each camming surface 111 and the following notch is a substantially flat raised surface 112. Each raised surface 112 of the rod 103 is flush with or slightly higher than the raised surfaces 108 of the stem 50 when the surfaces are aligned.

Pulling up on the height adjustment lever 101 raises the rod 103 so that initially the camming surfaces 111 become aligned with the notches 107 of the upper stem 50. Further upward movement of the height adjustment lever 101 causes the raised surfaces 112 of the rod 103 to become aligned with the notches 107 of the upper stem. In that position, the notches 110 of the rod 103 will be aligned with the raised surfaces 108 of the upper stem 50. Therefore, a sliding surface is provided along the stem and the rod.

The recesses in the inner stem and the release member may face in a forward, rearward or sideways direction when the arm assembly is attached to a chair.

Figure 5:
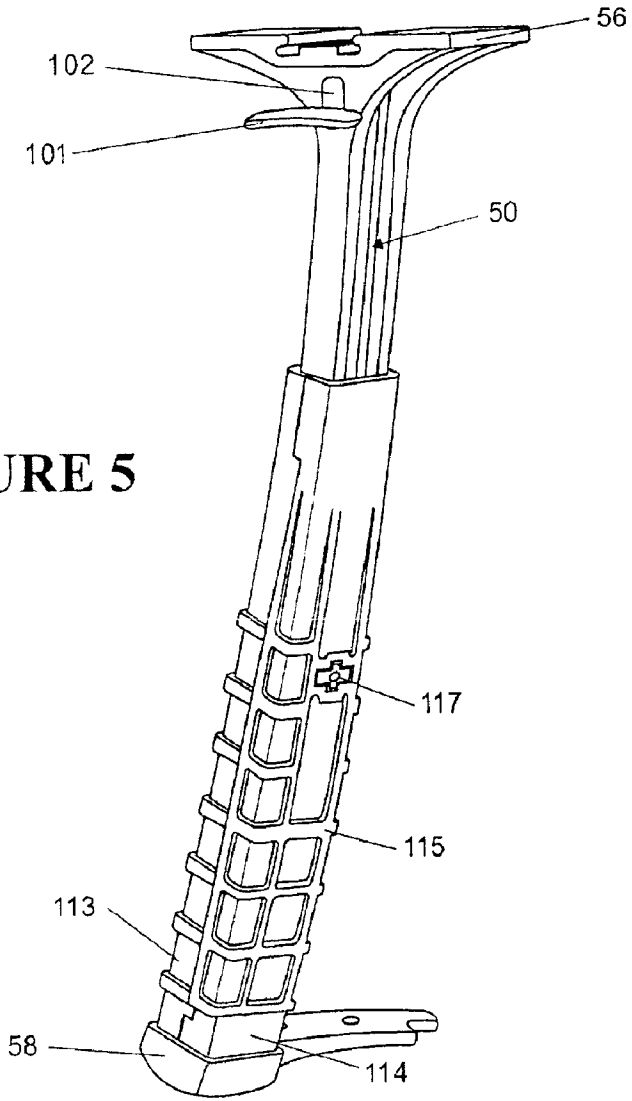
FIG. 5 is an assembled perspective view of the upper inner stem and liner of the arm assembly of FIG. 2.

The lower end of the upper stem 50 is preferably received within two half portions of a stem liner as shown in FIG. 5. The two half portions 113, 114 together define a central conduit within which the lower part of the upper stem 50 is telescopically received. The half portions 113, 114 fill part of the void within the hollow lower stem 52. Ribs 115 assist with filling the void and also add strength to the half portions of the stem liner.

The liner is preferably made of a plastics material, and is more preferably made of Acetal. The plastics material is suitably self-lubricating.

The stem liner is sized to be a reasonably snug fit within the lower stem 52, and is maintained therein by virtue of a lower stem cap 58. Additionally, one half portion of the stem liner may have one or more integrally formed leaf springs (see FIG. 8) to bias the stem liner towards one side of the lower column portion 52. Furthermore, one or both of the half portions of the stem liner may have internal integrally formed leaf springs (see FIG. 10) to reduce any slack between the upper column portion 50 and the stem liner.

One half portion 114 of the stem liner includes an aperture 116 therethrough which is sized to receive a locking device. In this embodiment, the locking device is a pin 117 which is biased towards the upper stem 50 to engage the notches 107, 110 of the upper stem 50 and the rod 103 by a compression spring 118 which extends between the pin and an inner wall of the lower stem 52. An alternative biasing means is described below with reference to FIG. 7. It should be noted that the pin 117 need not be situated against the upper edge of the respective notch 110 of the rod when it is engaged in the notches 107 of the upper stem 50. In fact, the notches 110 are preferably sized so that their upper edges are located above the upper edges of the notches 107 of the upper stem to ensure the pin 117 engages in the notches of the upper stem. The primary function of the rod 103 is to release the pin 117 from the notches 107 of the upper stem.

Figure 6:
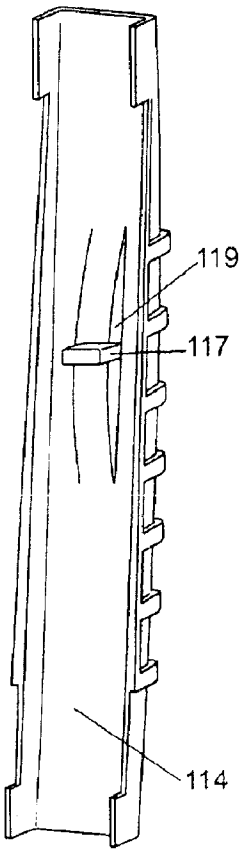
FIG. 6 is an inside view of one half of the liner of the arm assembly of FIG. 2, showing the locking pin extending therethrough.

A thickened strengthening portion 119 is provided in the wall of the liner half portion 114 immediately adjacent the aperture 116, as can be seen from FIG. 6. Vertical movement of the locking pin 117 is prevented by means of the thickened strengthening portion 119. When the actuating lever 101 is in the released position, the notches 110 of the rod 103 are aligned with the notches 107 of the upper stem 50. The locking pin 117 is of such a width to engage the notches 107 of the upper stem and be located in the notches 110 of the rod 103, and vertical movement of the upper stem 50 relative to the lower stem 52 is prevented by virtue of the engagement of the pin 117 in the notches 107.

When it is desired to adjust the height of the armrest 26, the user lifts the height adjustment lever 101 in order to move the rod 103 upwardly against the force of the spring 106 relative to the upper stem 50. As the rod 103 moves upwardly, one of the camming surfaces 111 forces the locking pin 117 against the force of the spring 118 out of engagement with a pair of aligned notches 107 of the upper stem 50 and back into the aperture of the liner. Further upward movement of the rod 103 brings the raised surfaces 112 of the rod into alignment with the notches 107 of the upper stem 50, such that the locking pin 117 will be prevented from engaging any of the notches 107 of the upper stem by the raised surfaces 112 of the rod 103. The upper stem 50 can then be moved relative to the lower stem 52.

Once the height of the armrest has been adjusted as desired, the user releases the lever 101. This will result in the notches 110 of the rod 103 coming back into alignment with the notches 107 of the upper stem 50, by virtue of the spring 106. With possibly some slight adjustment required, the locking pin 117 will move with the bias of the spring 118 into engagement with two aligned notches 107 of the upper stem 50 and a notch 110 of the rod 103, thereby again locking the vertical position of the upper stem 50 relative to the lower stem 52.

It will be appreciated that the number of pairs of vertically spaced notches in the upper stem 50 will determine the number of discrete locked positions of the upper stem 50 relative to the lower stem 52. The particularly preferred embodiment has seven pairs of notches 107, but more or less notches may be provided as desired.

Figure 7:
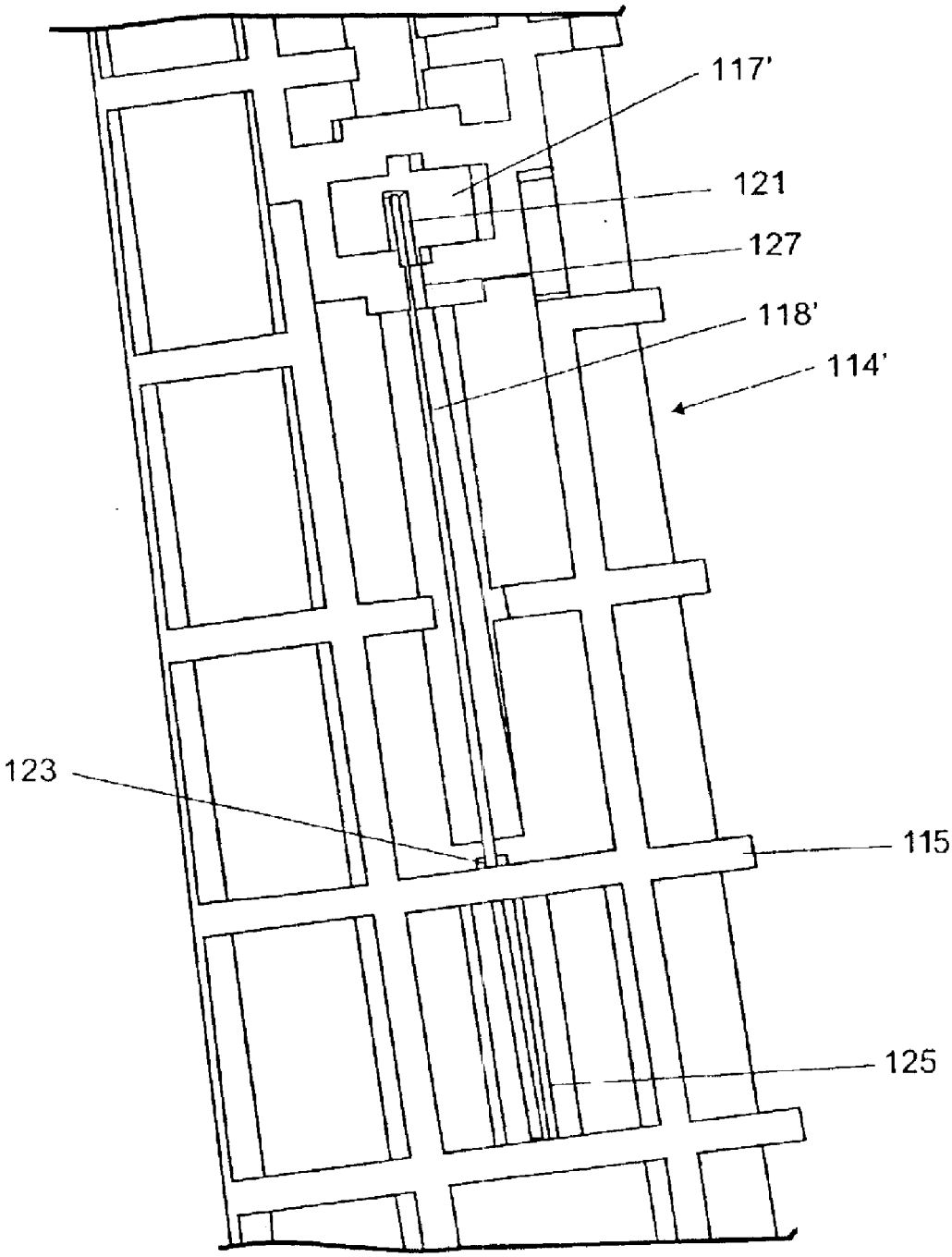
FIG. 7 is an outside view of one half of the liner for the arm assembly of FIG. 2, and showing a different biasing device to bias the locking pin towards the notches.

FIG. 7 shows an alternative device for biasing the locking pin towards the notches of the upper stem 50, in which like reference numerals are used to indicate like parts to FIGS. 2 to 6. Rather than using a compression spring, the locking pin 117' is biased towards the notches by means of a cantilevered leaf spring 118'. The cantilevered leaf spring 118' extends from a groove 125 in the liner, through an undercut 123 in one of the ribs 115, through a further groove 127 in the liner and into a groove 121 in the rear surface of the locking pin 117'. As the locking pin is pushed outwards, the spring 118' resiliently bends.

Alternatively, a leaf spring could be formed as an integral part of the locking pin 117', and could function in a similar manner to that of FIG. 7.

While preferred embodiments have been described above, modifications can be made thereto without departing from the scope of the invention.

While a locking pin is described above, other forms of locking device may be used in the height adjustable arm assembly. For example, the recesses in the stem and rod could be in the form of spaced annular recesses with raised portions therebetween, and the locking device could include a roller biased to engage in the recesses in the locked position to prevent movement of the upper stem relative to the lower stem. This configuration could function in the same way as that described above.

Figure 8:
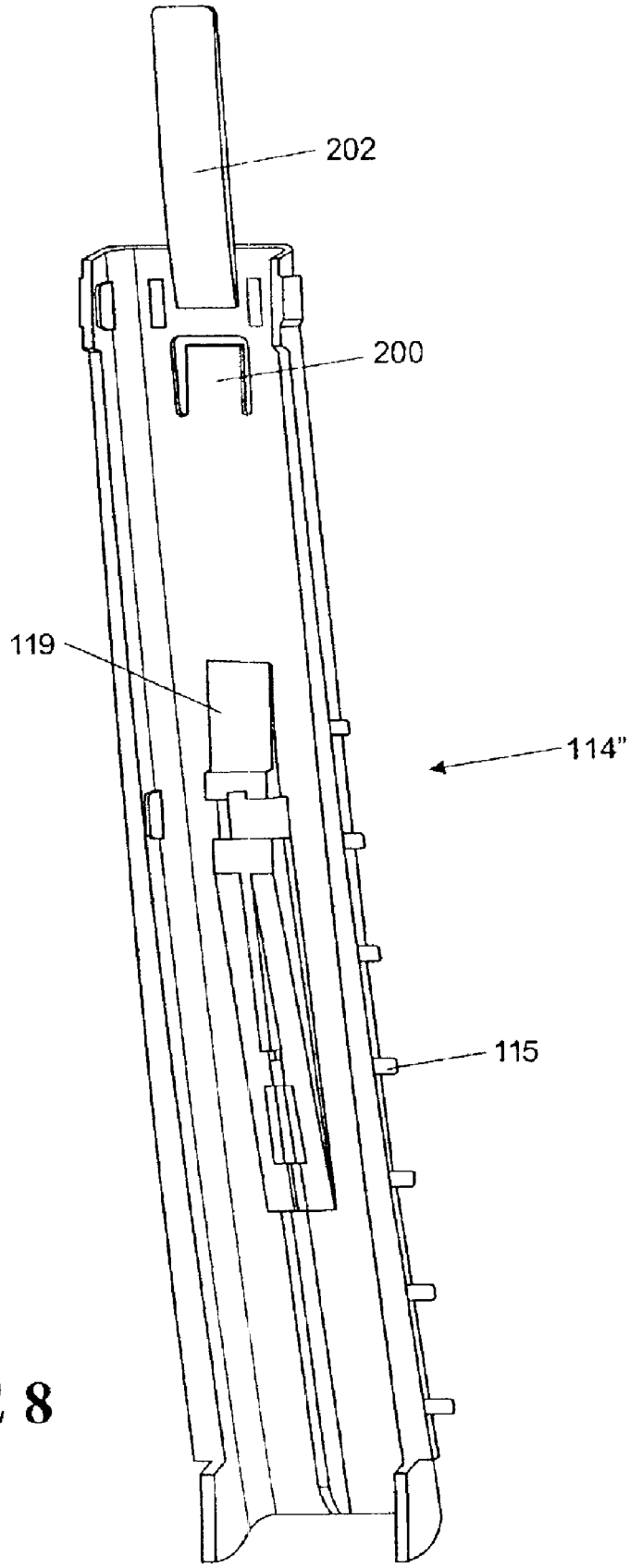
FIG. 8 is an inside view of one half of a further alternative liner for the arm assembly of FIG. 2.
Figure 9:
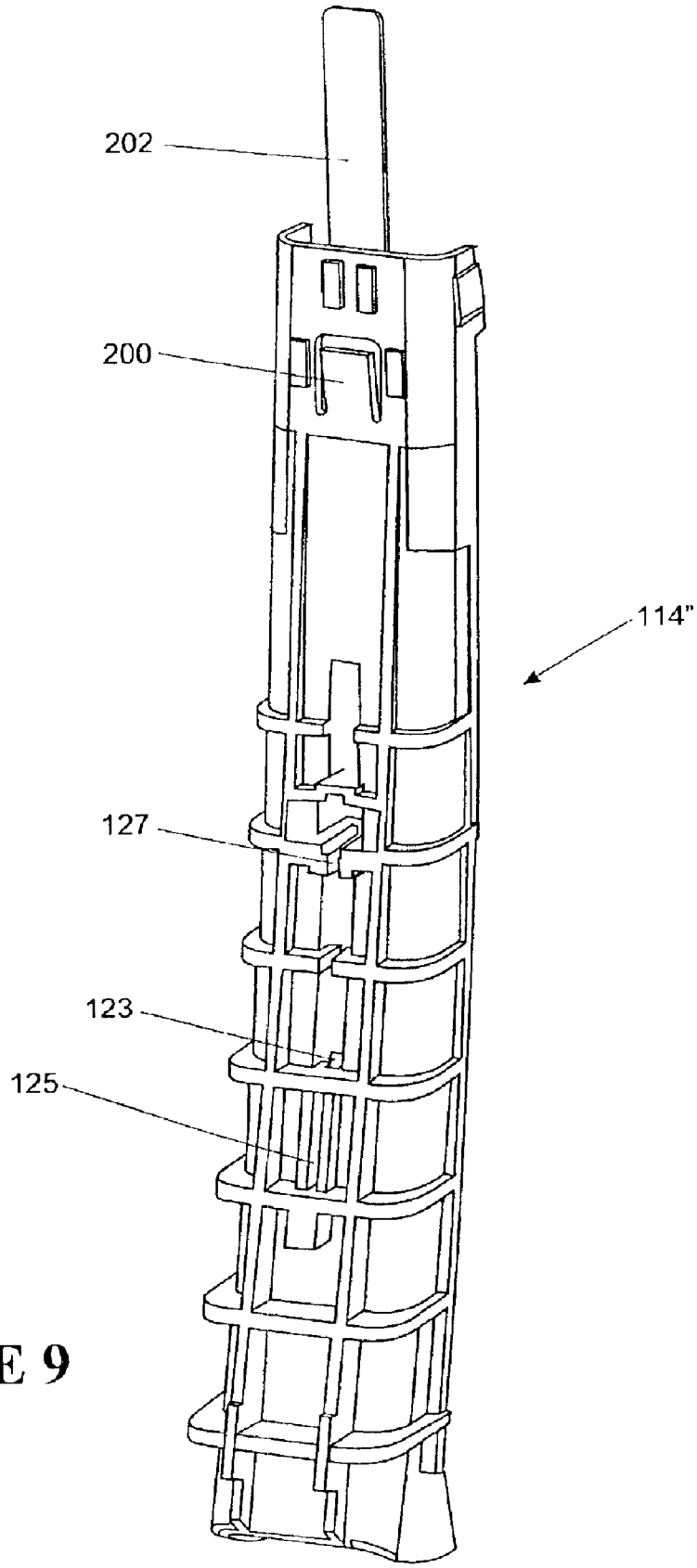
FIG. 9 is an outside view of the half of the liner of FIG. 8.
Figure 10:
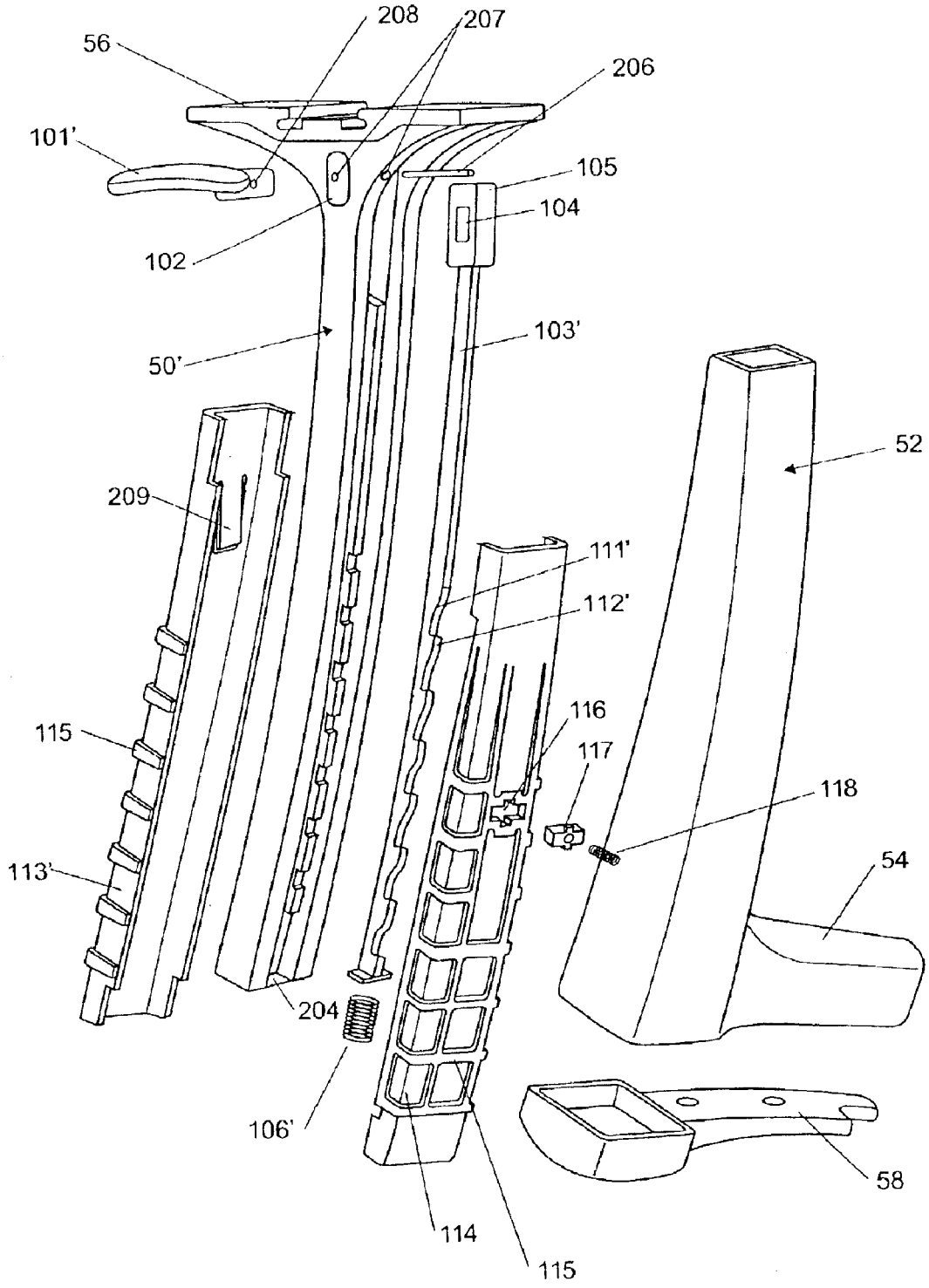
FIG. 10 is an exploded perspective view of the components of an arm assembly in accordance with an alternative preferred embodiment of the present invention, which may be used with the chair of FIG. 1.

FIGS. 8 and 9 show half of an alternative embodiment liner which may be used in the arm assembly. Unless described below, the features should be considered to be the same as those of FIGS. 2 to 7, and like reference numerals are used to indicate like parts. The main differences are that the modified half 114" of the liner includes an outwardly extending integral leaf spring 200 configured to engage an inner surface of the outer stem 52, thereby reducing slack between the liner and the outer stem. This also assists in reducing slack between the liner and the inner stem. However, if desired or necessary an inwardly-extending leaf spring may be provided in one of the liner halves, to reduce slack between the liner half and the inner stem 50 (and such a configuration is shown in FIG. 10). The liner half 114" also includes an upwardly-extending tongue 202 which covers the internal mechanism in the inner stem (i.e. the notches in the release member and the inner stem) to prevent a chair occupant from getting their fingers caught in the mechanism during adjustment. The tongue is preferably sized so as to not limit the movement of the inner stem 50 into the outer stem 52, but so as to fully cover the notches in the inner stem and the release member when the inner stem is in the fully extended position.

In the embodiment shown in FIGS. 2 to 7, the camming surface 111 defines the lower edge of each notch 110 in the rod 103. Alternatively, the angled or curved camming surfaces may define the upper edge of each notch in the rod and such an embodiment is shown in FIG. 10. Unless described below, the features should be considered to be the same as those of FIGS. 2 to 7, and like reference numerals are used to indicate like parts. In this embodiment, the release member is again in the form of a rod 103' and is biased upwardly by a spring 106'. The spring acts against a lower surface 204 of the inner stem. The height adjustment lever 101' is attached to the upper stem 50' via a pivot, so that pulling up on the lever 101' causes the rod 103' to move downwardly in the inner stem 50', bringing firstly the camming surfaces 111' and then the flat surfaces 112' into alignment with the notches 107 of the upper stem 50' to release the locking device from the notches of the inner stem. The pivot is provided by a pin 206 which extends through apertures 207 in the inner stem 50' and an aperture 208 in the lever 103'. This Figure also shows an inwardly-extending leaf spring 208 in one half 113 of the liner to reduce slack between the inner stem 50' and the liner.

While the preferred embodiment has been described with reference to a height adjustable arm assembly for a chair, such an arm assembly could be used for height adjustment of other components, in particular furniture components such as a height adjustable visual display unit (VDU) platform, or in the legs of a height adjustable table or desk.

The preferred release member is a notched rod, although it will be appreciated that other forms of release member having recesses may be utilised which are slidable relative to the upper stem.

Figure 11:
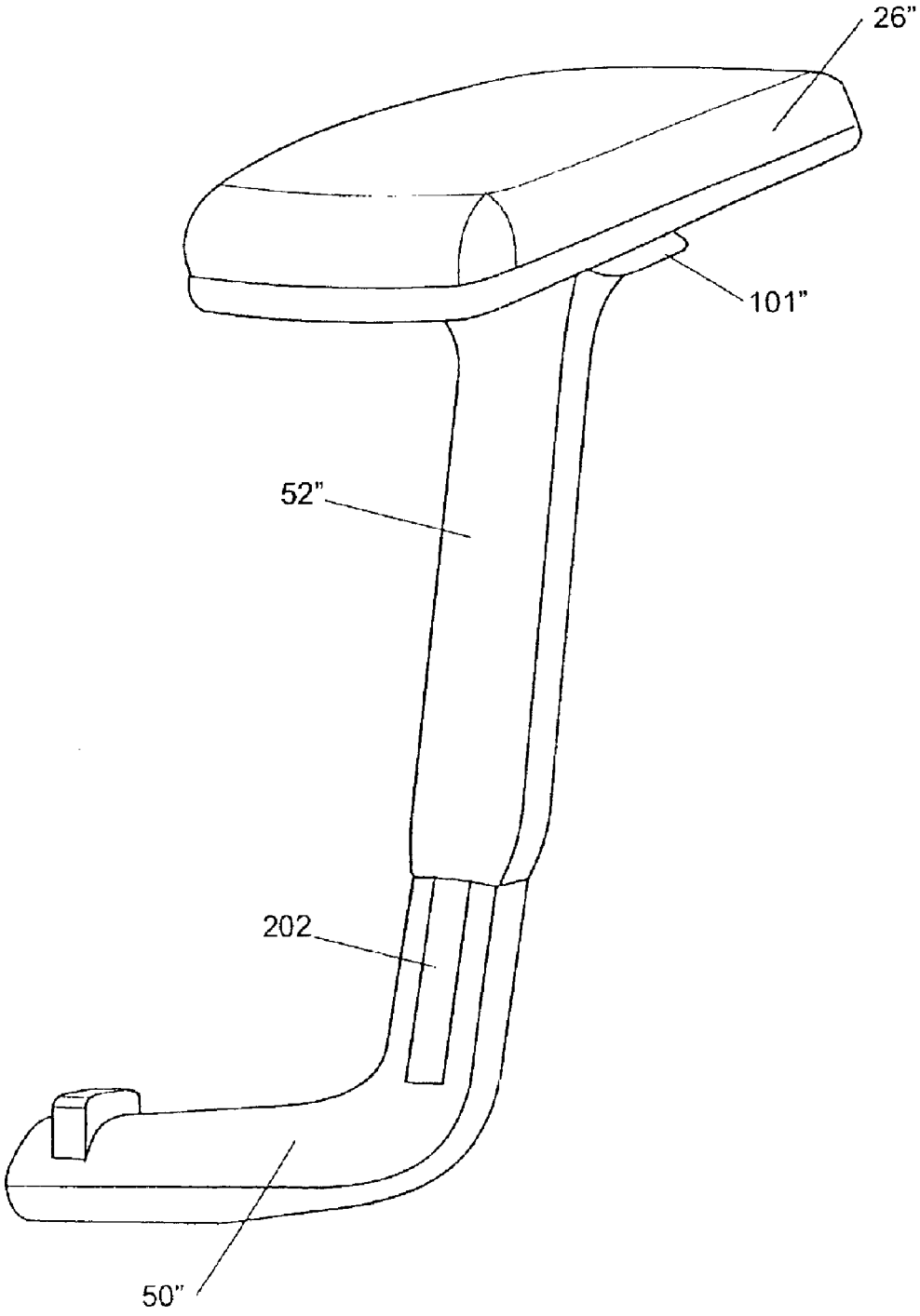
FIG. 11 is a general external perspective view of an alternative preferred embodiment arm assembly.

Further, in the preferred embodiments described above, the armrest is attachable to the inner stem and the outer stem is attachable to the chair. The assembly could be substantially inverted so that the armrest is attachable to the outer stem (which would therefore be the upper stem) and the inner stem is attachable to the chair (and would therefore be the lower stem). FIG. 11 shows a general external perspective view of such an arrangement. Again, unless described below the features should be considered the same as those of the above Figures. In this embodiment, the inner stem 50" is the lower stem configured to attachment to a chair, and the outer stem 52" is the upper stem configured for attachment to the armrest 26". Although not visible from the Figure, the outer stem again preferably contains a liner in which the inner stem is received. A tongue 202 is visible in the Figure, which extends from the liner to cover the channel in the inner stem which contains the release member and recesses of the inner stem.

Instead of the actuator lever being mounted at or adjacent an end of the inner stem as in the previous embodiments, so that it may be easily reached from the armrest 26", the lever 101" is mounted at or adjacent an end of the outer stem 52" distal from the inner stem 50". The lever 101" is operably connected to the release member which is slidably mounted in the inner stem 50".

Again, the camming surfaces in the release member may form either the upper edge or lower edge of each recess in the release member, and the actuator lever will be either pivotally attached to or slidably mounted in the outer stem 52" depending on the embodiment. For example, if the camming surfaces define the upper edge of each recess of the release member, the release member will typically be biased upwardly, and the actuator lever will be pivotally attached to the outer stem 52". Alternatively, if the camming surfaces define the lower edge of each recess of the release member, the release member will typically be biased downwardly, and the actuator lever will be slidably mounted in the outer stem 52".

The preferred embodiments described above provide a reliable and accurate height adjustment mechanism for an armrest, which uses few moving parts.

A user can easily adjust the height of the armrest as desired by simply raising the height adjustment lever and moving the upper stem relative to the lower stem.

Further, the recesses, strengthened thickened wall portion of the liner around the aperture, and the locking device provide strong fixing of the arm assembly in a desired position, meaning that a user can bear considerable force against the armrest without it moving while locked in position.

What is claimed is:

1. A height adjustable arm assembly for a chair comprising:

an outer stem attachable to a first chair component;

an inner stem attachable to a second chair component and slidably received in the outer stem and including a plurality of recesses spaced along a length thereof;

a locking device biased to engage one or more of the plurality of recesses to lock the position of the inner stem relative to the outer stem;

and a release member in operable connection with an actuator and having a plurality of recesses with raised surfaces therebetween, the release member being slidably moveable relative to the inner stem between a first position in which at least one of the recesses in the release member is aligned with at least one of the recesses of the inner stem and the locking device engages at least one of the recesses in the inner stem to inhibit movement of the inner stem relative to the outer stem, and a second position in which one or more of the raised surfaces of the release member aligns with the one or more recesses of the inner stem to remove the locking device from engagement with the recess or recesses and to provide a surface over which the locking device can slide to enable relative movement between the inner stem and the outer stem.

2. A height adjustable arm assembly as claimed in claim 1, wherein the release member comprises camming surfaces adjacent the recesses, the camming surfaces configured so that when one of the camming surfaces is moved into alignment with the recess or recesses of the inner stem with which the locking device is engaged, the locking device is progressively forced from engagement with said recess or recesses of the inner stem.

3. A height adjustable arm assembly as claimed in claim 2, wherein the raised surfaces of the release member are provided between respective camming surfaces and respective following recesses, such that initial movement of the release member progressively forces the locking device from the recess or recesses of the inner stem, and further movement brings one of the raised surfaces into alignment with the recess or recesses of the inner stem.

4. A height adjustable arm assembly as claimed in claim 1, wherein the inner stem comprises a longitudinal channel adjacent the plurality of recesses, and the release member is slidably mounted in the longitudinal channel.

5. A height adjustable arm assembly as claimed in claim 1, wherein the inner stem comprises two rows of recesses with the channel being defined between the rows of recesses, and the release member is slidably mounted in the longitudinal channel between the two rows of recesses.

6. A height adjustable arm assembly as claimed in claim 1, wherein a liner is mounted in the outer stem, with the moving inner stem telescopically received in the liner.

7. A height adjustable arm assembly as claimed in claim 6, wherein the liner is a two-piece liner.

8. A height adjustable arm assembly as claimed in claim 6, wherein the liner is made of a plastics material.

9. A height adjustable arm assembly as claimed in claim 6, wherein the liner comprises an aperture for receipt of the locking device, and the locking device extends inwardly through the aperture.

10. A height adjustable arm assembly as claimed in claim 9, wherein the liner comprises a strengthened region adjacent the aperture for receipt of the locking device, to enhance the rigidity of the locking device.

11. A height adjustable arm assembly as claimed in claim 6, wherein the liner comprises an outwardly-extending leaf spring to reduce slack between the liner and the outer stem.

12. A height adjustable arm assembly as claimed in claim 6, wherein the liner comprises an inwardly-extending leaf spring to reduce slack between the liner and in the inner stem.

13. A height adjustable arm assembly as claimed in claim 6, wherein the locking device comprises a locking pin which is biased towards the recesses of the inner stem.

14. A height adjustable arm assembly as claimed in claim 13, wherein a coil spring extends between a surface of the outer stem and the locking pin, to bias the locking pin towards the recesses.

15. A height adjustable arm assembly as claimed in claim 13, wherein a leaf spring or spring wire biases the locking pin towards the recesses of the inner stem.

16. A height adjustable arm assembly as claimed in claim 15, wherein the liner comprises a groove for receipt of the leaf spring or spring wire which extends behind the locking pin to bias the locking pin towards the recesses of the inner stem.

17. A height adjustable arm assembly as claimed in claim 16, wherein the liner comprises strengthening ribs, and the groove is defined by an undercut in one or more of the strengthening ribs.

18. A height adjustable arm assembly as claimed in claim 1, wherein the locking device comprises a locking pin which is biased towards the recesses of the inner stem.

19. A height adjustable arm assembly as claimed in claim 18, wherein a coil spring extends between a surface of the outer stem and the locking pin, to bias the locking pin towards the recesses.

20. A height adjustable arm assembly as claimed in claim 18, wherein a leaf spring or spring wire biases the locking pin towards the recesses of the inner stem.

21. A height adjustable arm assembly as claimed claim 1, wherein the outer stem comprises a stem cap to close off the end of the outer stem opposite to the end through which the inner stem extends

22. A height adjustable arm assembly as claimed in claim 1, wherein the release member comprises an elongate member.

23. A height adjustable arm assembly as claimed in claim 22, wherein the release member comprises a rod.

24. A height adjustable arm assembly as claimed claim 1, wherein the recesses in the inner stem and in the release member are in the form of notches.

25. A height adjustable arm assembly as claimed in claim 1, wherein the inner stem is an upper stem configured for attachment to an armrest, and the outer stem is a lower stem configured for attachment to a chair.

26. A height adjustable arm assembly as claimed in claim 25, wherein a camming surface defines an edge of each recess of the release member towards the outer stem, such that movement of the release member away from the outer stem forces the locking device from the recess or recesses of the inner stem.

27. A height adjustable arm assembly as claimed in claim 26, wherein the release member is biased in a direction toward the outer stem.

28. A height adjustable arm assembly as claimed in claim 26, wherein the actuator comprises a height adjustment lever extending through the inner stem at or adjacent an end thereof distal from the outer stem, which lever is in operable engagement with the release member.

29. A height adjustable arm assembly as claimed in claim 28, wherein the lever is slidably mounted in the inner stem such that moving the lever in a direction away from the outer stem moves the release member in a direction away from the outer stem and thereby forces the locking device from the recess or recesses of the inner stem, enabling the relative positions of the inner and outer stems to be adjusted.

30. A height adjustable arm assembly as claimed in claim 25, wherein a camming surface defines an edge of each recess of the release member away from the outer stem, such that movement of the release member towards the outer stem forces the locking device from the recess or recesses of the inner stem.

31. A height adjustable arm assembly as claimed in claim 30, wherein the release member is biased in a direction away from the inner stem.

32. A height adjustable arm assembly as claimed in claim 30, wherein the actuator comprises a height adjustment lever extending through the inner stem at or adjacent an end thereof distal from the outer stem, which lever is in operable engagement with the release member.

33. A height adjustable arm assembly as claimed in claim 32, wherein the lever is pivotally mounted to the inner stem such that moving an outer part of the lever in a direction away from the outer stem moves the release member toward the outer stem and thereby forces the locking device from the recess or recesses of the inner stem, enabling the relative positions of the inner and outer stems to be adjusted.

34. A height adjustable arm assembly as claimed in claim 1, wherein the inner stem is a lower stem configured for attachment to a chair, and the outer stem is an upper stem configured for attachment to an armrest.

35. A height adjustable arm assembly as claimed in claim 34, wherein a camming surface defines an edge of each recess of the release member towards the outer stem, such that movement of the release member away from the outer stem forces the locking device from the recess or recesses of the inner stem.

36. A height adjustable arm assembly as claimed in claim 35, wherein the release member is biased in a direction toward the outer stem.

37. A height adjustable arm assembly as claimed in claim 35, wherein the actuator comprises a height adjustment lever extending through the outer stem at or adjacent an end thereof distal from the inner stem, which lever is in operable engagement with the release member.

38. A height adjustable arm assembly as claimed in claim 37, wherein the lever is pivotally mounted to the outer stem such that moving an outer part of the lever away from the inner stem moves the release member away from the outer stem and thereby forces the locking device from the recess or recesses of the inner stem, enabling the relative positions of the inner and outer stems to be adjusted

39. A height adjustable arm assembly as claimed in claim 34, wherein a camming surface defines an edge of each recess of the release member away from the outer stem, such that movement of the release member towards the outer stem forces the locking device from the recess or recesses of the inner stem.

40. A height adjustable arm assembly as claimed in claim 39, wherein the release member is biased in a direction away from the inner stem.

41. A height adjustable arm assembly as claimed in claim 39, wherein the actuator comprises a height adjustment lever extending through the inner stem at or adjacent an end thereof distal from the inner stem, which lever is in operable engagement with the release member.

42. A height adjustable arm assembly as claimed in claim 41, wherein the lever is slidably mounted to the outer stem such that moving the lever in a direction away from the inner stem moves the release member toward the outer stem and thereby forces the locking device from the recess or recesses of the inner stem, enabling the relative positions of the inner and outer stems to be adjusted.

43. A height adjustable arm assembly as claimed in claim 1, comprising a cover which covers the recesses of the inner stem and the release member.

44. A height adjustable arm assembly as claimed in claim 43, and including a liner in the outer stem, wherein the cover comprises a tongue extending from the liner.

45. An office chair comprising a pair of height adjustable arm assemblies as claimed in claim 1 attached thereto, the arm assemblies supporting armrests from the chair.

* * * * *